United States Patent [19]

Keller

[11] Patent Number: 5,054,503

[45] Date of Patent: Oct. 8, 1991

[54] CLOSABLE CONTAINER HAVING ABASIVE BODY IN FINGER TREATING SOLUTION

[76] Inventor: Walter Keller, Huebwiesenstrasse 7b, Geroldswil, Switzerland

[21] Appl. No.: 274,808

[22] PCT Filed: Feb. 5, 1988

[86] PCT No.: PCT/CH88/00028

§ 371 Date: Oct. 18, 1988

§ 102(e) Date: Oct. 18, 1988

[87] PCT Pub. No.: WO88/06015

PCT Pub. Date: Aug. 25, 1988

[30] Foreign Application Priority Data

Feb. 18, 1987 [CH] Switzerland ..... 598/87
Apr. 3, 1987 [CH] Switzerland ..... 1304/87

[51] Int. Cl.[5] ..... A45D 29/00

[52] U.S. Cl. ..... 132/73; 132/74.5; 132/75

[58] Field of Search ..... 132/73, 73.5, 74.5, 132/75; 206/209, 210, 581, 823; 220/258

[56] References Cited

U.S. PATENT DOCUMENTS 3,369,553 2/1968 Keesee ..... 132/73.5
4,282,891 8/1981 Duceppe ..... 132/73.5
4,321,936 3/1982 Chaconas ..... 132/73.5
4,440,181 4/1984 Scherer ..... 132/73.5
4,466,452 8/1984 Ferrari ..... 132/75
4,530,726 7/1985 Montiel ..... 132/73.5

FOREIGN PATENT DOCUMENTS 0193496 9/1986 European Pat. Off. ..... 132/73

*Primary Examiner*—John J. Wilson
*Assistant Examiner*—Frank A. LaViola

[57] ABSTRACT

Container for treating fingers or finger nails includes a cup with a sponge therein immersed in a treatment solution. The container is provided with a double walled seal, which is connected positively and/or non-positively to the inner wall of the cup of the container. At the top, the inner seal engages against a shoulder of the cup and secures the underlying sponge. The sponge has a vertically extending hole for receiving a finger to be treated. The sponge absorbs the liquid or solution contained in the cup for treating finger. The hole can be provided with a replaceable lining. Closable slits are provided in the seal for the insertion of the finger, so that no liquid flows out or evaporates. The seal can be held on its circumference by a spring ring, which engages against a cam or is located in a groove in the inner wall of the cup and is consequently positively held.

27 Claims, 3 Drawing Sheets

FIG. 1
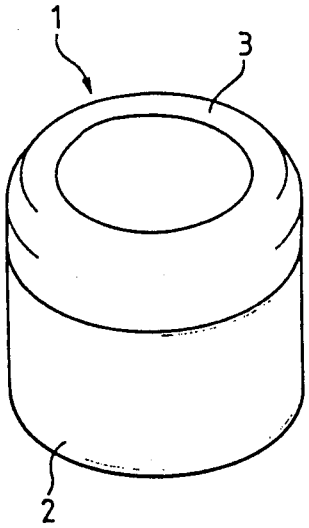
FIG. 2
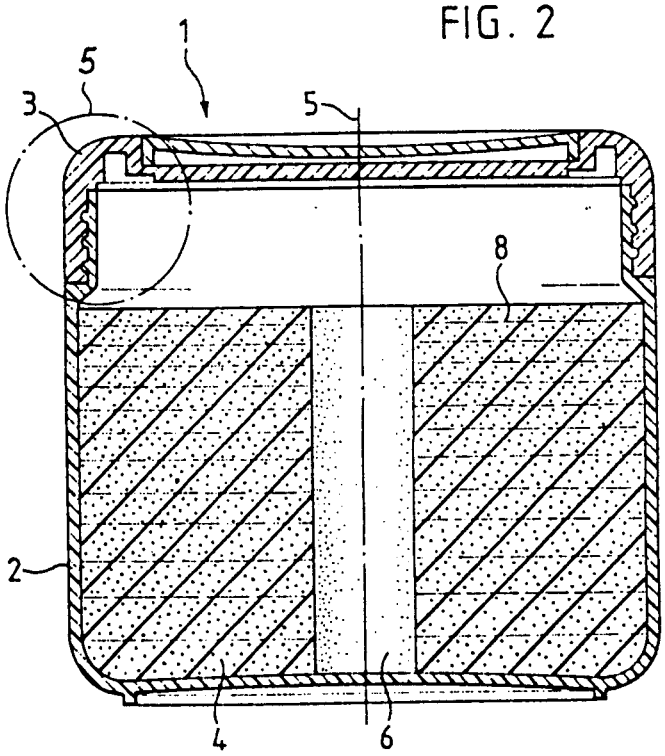
FIG. 4
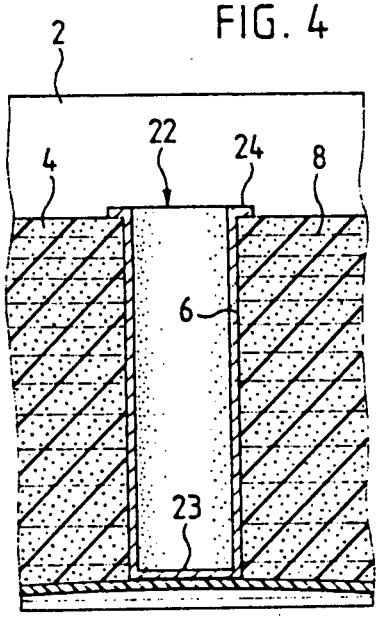
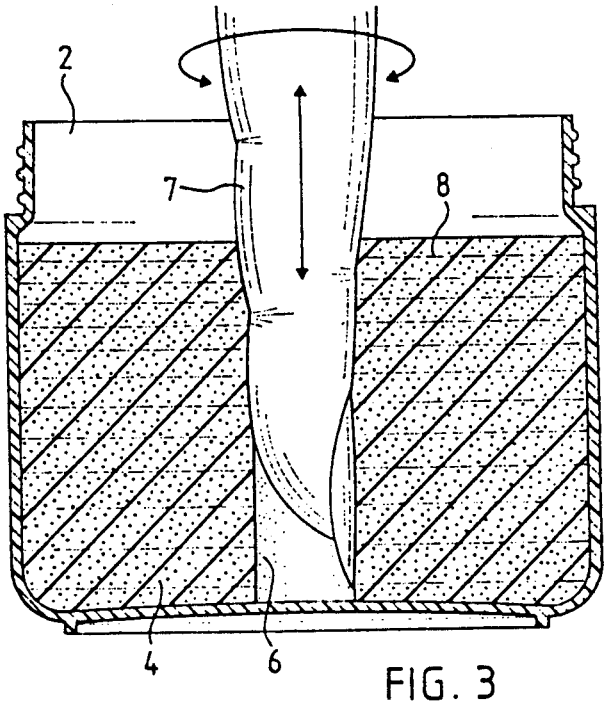
FIG. 3

FIG. 12
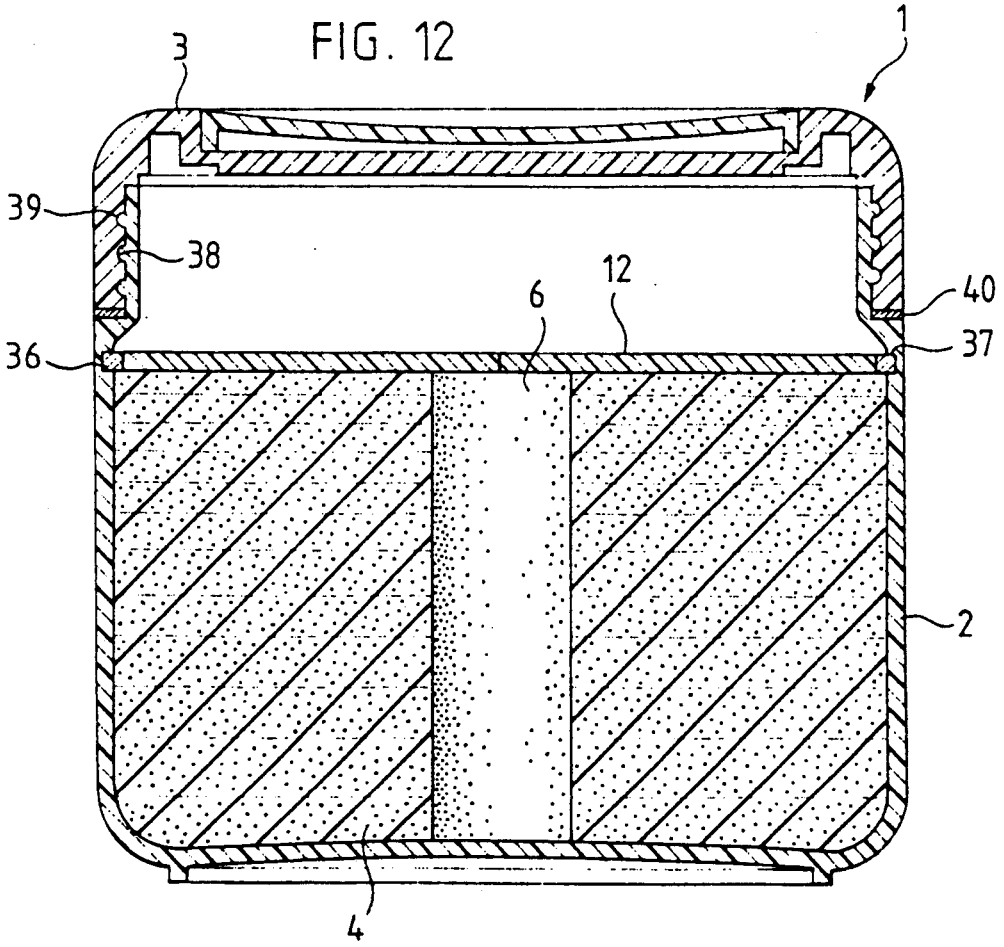
FIG. 13
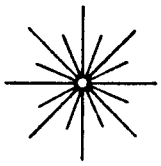
FIG. 16
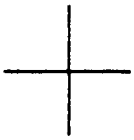
FIG. 14
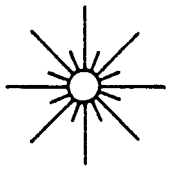
FIG. 17
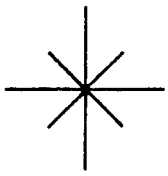
FIG. 15
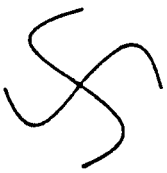
FIG. 18

CLOSABLE CONTAINER HAVING ABASIVE BODY IN FINGER TREATING SOLUTION

BACKGROUND OF THE INVENTION

The present invention relates to a closable or sealable container containers of the foregoing type are mainly used for removing nail varnish, and also for cleaning and caring for the fingers. For removing nail varnish the finger or fingers are immersed in the container, so that the nail is wetted by a solution or liquid. The nail is then rubbed against a surface until the nail varnish is removed. A mixture of acetone, lanolin and other additives is mainly used as the liquid.

The mixture of etching (acetone) and fat-containing (lanolin) constituents can cause damage to clothing, furniture, etc., if the container overturns as a result of unskillful handling. In order to avoid such damage, a container construction has been sought, in which only small liquid quantities can run out if the container is overturned or placed upside down with the lid or top removed.

Such a construction is disclosed in U.S. Pat. No. 4,321,936, but the bottle shape is rather complicated. In the lower part is provided a grid and an abrasive body is inserted at the top and comprises several segments. Thus, no continuous surface is available on cleaning the finger. As a result of the bottle-shaped construction only one finger can be inserted in the container and despite the slots provided in two superimposed seals there is only a temporary protection against the liquid running out.

U.S. Pat. No. 4,466,452 describes another container with a liquid for treating finger nails in which a sponge with a through hole is provided. The sponge is pressed by a cup spring against the bottom or is fixed to the bottom by a fastening. In order to make the outflow of liquid from the container difficult, the upper edge of the open container is provided with a circular wall, which extends radially inwards.

In this construction, a delayed outflow of the liquid from an overturned container is only temporarily ensured. However, if the container is placed upside down, there is virtually no protection against any outflow. However, the continuous inner surface of the sponge forms an uninterrupted abrasive surface. To the extent that there is a sharp inner cup spring edge, it is prejudicial when cleaning the fingers.

In this connection reference is made to another problem. If the container is e.g. heated by the sun, acetone with its low evaporation temperature tends to splash if a finger is inserted through an expandable closure into the container and consequently the volume is somewhat reduced.

In addition, U.S. Pat. No. 4,282,891 describes a construction in which the liquid is at least partly held back by the sponge. As a relatively large liquid quantity is a requirement for a satisfactory functioning of the nail varnish remover, the liquid not absorbed by the sponge can flow out, which can cause stains on clothing and carpets.

Therefore there is a need for an improvement to the existing constructions, so that damage to clothing, carpets and furniture is avoided through outflowing nail varnish remover liquid.

Another disadvantage of the construction according to U.S. Pat. No. 4,282,891 is that the container is only liquid-tight and gas-tight to a limited extent. This applies both before and after the first opening of the container and means that the container cannot hold the filled liquid without evaporation.

If the container remains full for a certain time, the content can evaporate, so that there is an unpleasant smell in the place of sale or home. Moreover, in this case the customer only receives part of the product sold.

SUMMARY OF THE INVENTION

It is an object of the present invention to provide a container of the aforementioned type, which does not suffer from the disadvantages thereof.

This container must be able to lie on its side with the cover removed and at least temporarily be positioned upside down without permitting the liquid to flow out. It must also be possible to store filled containers for a long period without any partial evaporation of the liquid contained therein. Moreover the container must be inexpensive and easy to manufacture, whilst being suitable for liquids which are friendly to the environment.

As the hitherto used liquids, e.g. acetone in the case of nail varnish removers, can be highly prejudicial to clothing, furniture and carpets, it is important for the liquid not to unintentionally flow out or evaporate.

The measures taken ensure that the liquid cannot flow out or evaporate if the container is unintentionally turned on its side or stored for a long period. In addition, in one embodiment there is a hermetic seal of the container, so that the liquid cannot evaporate if the container is temporarily left unused.

An embodiment of the invention is described in greater detail hereinafter relative to the drawings, wherein show:

BRIEF DESCRIPTION OF THE DRAWINGS

FIG. 1 is a perspective view of a closed container;

FIG. 2 is an axial vertical section through the container of FIG. 1;

FIG. 3 is a sectional view similar to that of FIG. 2, but showing the container in the open state and with the finger inserted;

FIG. 4 is a detail of FIG. 2 with the dirt sleeve inserted;

FIG. 12 is a vertical section through a closed container; and

FIG. 13 to FIG. 18 illustrate different shapes of the incisions in the sponge or in the cover or seal.

DETAILED DESCRIPTION OF THE PREFERRED EMBODIMENTS

Figure 5:
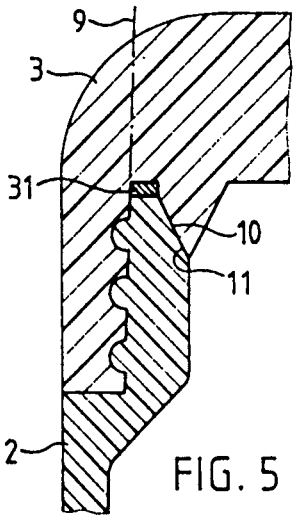
FIG. 5 is a detail V of FIG. 2, on a larger scale.

FIGS. 1 and 2 show a container 1 comprising a cup 2 and a screw cover 3, a roller-like sponge 4 being located in the container interior. A hole 6 for receiving a finger 7 extends through the sponge 4 coaxially to the axis of symmetry 5, as shown in FIG. 3. The cup contains a liquid 8 for removing nail varnish and which is partly absorbed by sponge 4.

Cover 3 is fixed by means of a thread, whose extended basal surface 9 intersects axis 5 for improving the seal, as shown in exaggerated form in FIG. 5. The screw thread can also be replaced by a bayonet catch. The inner wall of the cup 2 at the top passes slightly conically to the outside and forms a frustum surface 10, against which engages a correspondingly constructed surface 11 on a projection on cover 3 which is conical and circular in radial section. There is a slight divergence between the angles of the two surfaces 10 and 11 with respect to axis 5, in order to improve the seal.

Figure 6:
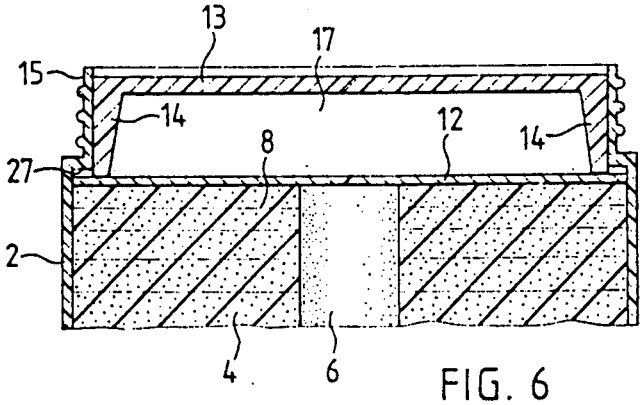
FIG. 6 is a partial sectional view of the variant of the embodiment of FIG. 3.

The aforementioned seal is normally adequate for preventing evaporation when the cover 3 is closed; in the case of a cup 2 which has already been used, or which is temporarily left open during use, a further seal is necessary. As shown in FIG. 6, such a seal can comprise a disk 12, which positively and/or non-positively engages against the inner wall or in a groove therein, so that the content of cup 2 is hermetically sealed in to the initial use. The seal or disk 12' can have different thicknesses and can e.g. be thicker at the edge than in the center. Disk 12 can also be connected by welding or bonding to sponge 4. The seal or disk 12 engages against a shoulder 27 of cup 2 and secures thereby the underlying sponge 4.

Above the cup 2 is provided a further cap-like seal 13, whose two vertical walls 14 engage positively and/or non-positively against the inner wall of neck 15, there also being the possibility of producing a welded or bonded joint between seal 13 and the inner wall of neck 15.

Figure 7:
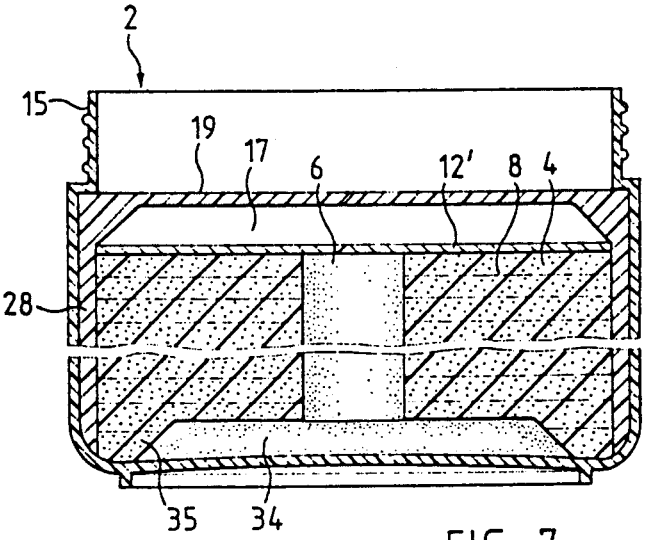
FIG. 7 is a sectional view of a first variant to FIG. 6.

FIG. 7 shows a construction, in which the vertical, cylindrical wall 15 extends to the bottom of cup 2, space 17 being displaced downwards is compared to that in FIG. 6, below neck 15. In said space 17 collects gas, which is formed if the container is exposed to heat, so that liquid 8 evaporates. Such evaporation can be prejudicial, because it leads to splashes, which can damage clothing or furniture. The seal in FIG. 7 comprises a disk 12' similarly to FIG. 6.

Figure 8:
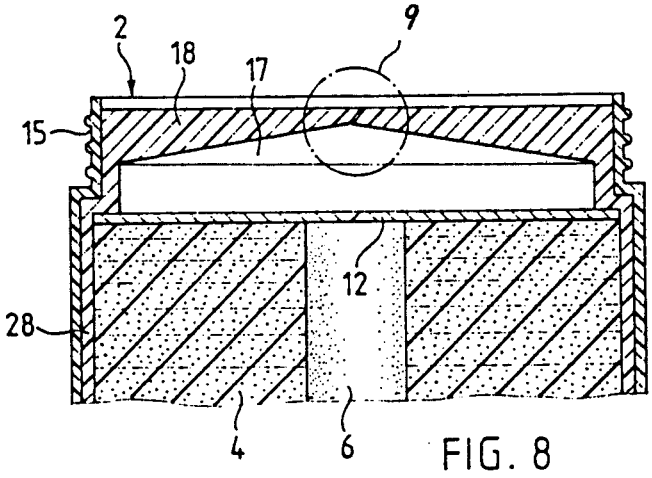
FIG. 8 is a partial section view of a construction similar to FIG. 6.

FIG. 8 shows a construction where the space 17 is roughly at the same height as in FIG. 6, but wall 16 extends to the bottom of cup 2, as in FIG. 7. In the construction according to FIG. 8 the upper end wall 18, like 13 in FIG. 6, is located in the neck area and in section has a modified shape compared with that according to FIGS. 6 and 7. The thickness of end wall 18 continuously increases from the centre to the edge, which gives said wall a high stability and therefore a very good sealing capacity.

Figure 9:
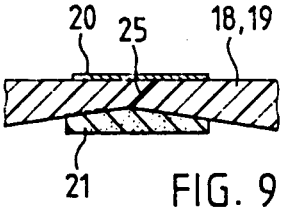
FIG. 9 is a detail IX from FIG. 8, on a larger scale.

In order that finger 7 can be inserted into the cup, holes or incisions are provided in seals 12, 13, 18, 19. The incisions can have random shapes and can be opened prior to use, e.g. by cutting or removing a stick-on label 20 (FIG. 9).

Figure 10:
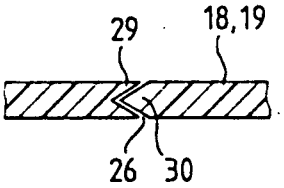
FIG. 10 is a detail of an embodiment varying from that of FIG. 9.

When viewed from above, the incisions can be linear or arcuate and should end somewhat before the outer circumference in order to avoid cracking and leakage hazards. In vertical section and at right angles to the incisions, they e.g. pass in sloping manner with respect to the horizontal plane (FIG. 9), or they comprise a wedge-shaped tongue 30, which engages in a groove 29 (FIG. 10), which improves the seal. In order that the outflow of evaporated liquid is delayed or prevented, a sponge pad 21 can be arranged on the inside of seal 19 and can be fixed to one side of the incision or slit 25, e.g. by welding and as shown in FIG. 9.

Pad 21 is pushed aside on inserting finger 7. The limited thickness of the centre of end wall 18 (FIG. 8) facilitates the insertion of finger 7, but still seals the interior of cup 2.

After container 1 has been used once, it contains dissolved nail varnish which has an unpleasant effect during the following use. Thus, in the construction according to FIG. 4 a sleeve or case 22 is provided, which is preferably sealed by a sleeve or case bottom 23. At the top the sleeve 22 has a border 24, which engages on the edge of hole 6 through sponge 4 and is secured by the latter. The sleeve or lining 22 is made from a stable, permeable material, e.g. a plastic carrier, which is internally lined with a tight abrasive material made from plastic or cotton.

The sleeve or lining 22 is preferably replaced after each use of the nail varnish remover. If this takes place immediately following use, the varnish has little possibility to penetrate the liquid and be deposited there, so that the interior of cup 2 has a clean appearance. The sleeve also has the advantage that it can be made from a material suitable for contact with the finger, whose absorptive capacity can be negligible.

If container 2 is used for finger nail treatment with the cover 3 removed, it can easily occur that it is turned over through carelessness and falls on the floor. It is important in such cases that little or no liquid flows out. This is achieved through the construction of slits 25, 26 with pad 21, which initially absorbs the liquid 8. Thus, an outflow risk only occurs after a certain time.

The incisions 25, 26 need not pass entirely through and can instead be linked by a very thin skin, which can easily be perforated by a finger. In addition, the seal 12' (FIG. 7) does not have to have an incision, but can be made from an easily perforatable material.

The bearing surface of the abrasive body or sponge 4 on the bottom of cup 2 (FIG. 7) can be annular, said ring 35 on the bottom defining a space 34 for liquid absorption.

Figure 11:
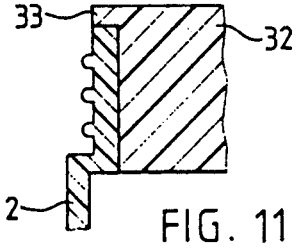
FIG. 11 is a partial sectional view of a second variant to FIG. 6 with a stopper.

FIG. 11 shows a stopper 32, having on its periphery an annular rim 33 for engaging and pressing on the opening edge. In this construction the stopper must be removed prior to use. However, stopper 32 can also have a form in which it does not have to be removed, cf. FIGS. 8, 9 or 10.

The liquid e.g. consists of acetone, lanolin, perfume and water, but acetone can be replaced by less volatile substances, such as glycol ether.

FIG. 12 shows container 1 comprising cup 2 and screw cover 3, which is provided with an internal thread 38, which engages in an external thread 39 on cup 2. Below cover 3 is provided a seal 40, e.g. of rubber, which largely prevents the evaporation of the content when container 1 is closed.

In the interior of container 1 is provided a sponge 4, which is centrally provided with incisions and/or a cylindrical hole 6 for inserting a finger. On the top of sponge 4 is provided seal 12, which greatly reduces liquid evaporation. This seal is made from a soft material, which permits virtually no liquid to pass through and is circumferentially provided with a spring ring 36, which engages non-positively in a closed groove 11, which extends in circular manner along the inner wall of cup 2.

Below seal 12 is provided the sponge 4, which is preferably made from a material, which only gives off the absorbed liquid if it is under a mechanical pressure. This ensures that the liquid in the sponge does not flow out if the container 1 is accidentally overturned, so that it comes to rest on its side or top.

The circular or angular seal 12 can be completely closed and be centrally provided with a perforation, which can be perforated with the finger or opened by means of a flap.

For the purpose of cleaning the inner wall of the cylindrical hole 6, it is possible to provide a plunger-like, not shown brush, which has a short handle at the top. This brush can be made from cylindrical, relatively hard foam or can be provided with bristles, whereby it can be kept separately or in the cup. For cleaning purposes the brush is moved up and down a few times and is optionally turned, so that varnish residues are removed from the inner wall of the hole. The brush can then be cleaned with water. According to FIGS. 12 to 18, hole 6 can be replaced by incisions with different shapes in seal 12. These incisions can be straight or S, cross, hooked cross or star-shaped and optionally be centrally provided with a hole 6 for inserting the finger. In the seal the incisions can be covered by an adhesive, which is only removed just prior to use. The incisions preferably extend up to the centre of the radius of the cover or seal 12, so that their tearing resistance is ensured.

Tests have shown that sponges with a weight of approximately 30 to 100 kg/m$^3$ are particularly suitable for retaining liquid. Particularly good results have been obtained with a sponge weighing 65 kg/m$^3$. It is possible to use various sponge-like materials, such as foam rubber, foam and natural sponges. However, for the insertion of the finger it is very important for the sponges to be made from soft material. It is preferable to use sponges with open or closed pores or fibres with these characteristics.

Sponges made from foam rubber or foam are consequently preferred, because these materials are very soft and can be manufactured precisely in accordance with requirements. However, in the case of natural sponges it can be very difficult to find a sponge, which has the optimum characteristics as regards weight and pores.

The sponge is made in such a way that it swells slightly through liquid absorption and consequently exerts a pressure on the container wall, so that no liquid can flow out between the latter and the sponge. This measure ensures that the sponge adheres firmly to the inner wall and does not rotate in the container during finger treatment.

The liquid can be constituted by conventional mixtures of acetone, lanolin, glycerol and water, but it is also possible to use acetone-free mixtures or solvents. In order that the liquid is even better retained in the sponge, it can be treated with a sealing liquid, which makes the escape of liquid even more difficult.

An acetone-based liquid can contain up to 99.7% acetone, up to 49.7% water, up to 5% lanolin derivative and up to 3% perfume concentrate. In a preferred embodiment these values are 80:18.7:0.8:0.5%.

The hitherto conventional liquids for removing nail varnish contained the very active agent acetone, which of late has increasingly fallen into disrepute for toxic reasons. However, acetone-free liquids often have a slightly increased cleaning time, but this can be reduced by holding the fingers in the air for a short time after moistening and before the actual varnish removal starts.

The forms of the incisions shown in FIGS. 12 to 18 serve as examples and can be extended at random. The incisions can be centrally provided with a hole for the insertion of the finger. It is important for the incisions to end somewhat prior to the edge, so that the container can be left for a virtually unlimited time on its side, without even drips flowing out of the liquid.

If the container is placed upside down with the cover removed, up to fifteen minutes can pass before a single drop flows out, but this time is dependent on no more liquid than necessary being present in cup 2. This liquid quantity is established on the basis of its composition, etc. It must be borne in mind that the finger is not normally bathed in the liquid and to a certain extent is used as a cleaning liquid for removing nail varnish residues.

In the preceding description it has been assumed that the sponge is shaped like a circular cylinder. However, the sponge can also be e.g. prismatic, triangular, pyramidal or frustum-shaped. A prismatic construction has the advantage that the sponge can be better held against a rotary movement. It is assumed in the case of a triangular, pyramidal or frustum-shaped construction that the sponge has a larger diameter at the bottom than at the top. In the case of corresponding container shaping, its stability is increased and also the holding of the sponge in the container is improved or facilitated.

In particular for transportation purposes, but also for long-lasting sealing, the container can be provided at the top with a covering, which is e.g. welded or bonded to the upper edge, the border of the covering extending down to the thread or even to the bottom part of said thread. The covering can be centrally provided with a perforation, which can be tightly sealed by means of a removable stick-on label.

In place of the aforementioned, normal thread, it is possible to use a bayonet catch, or an e.g. three times subdivided thread, in which the rotary movement for opening or closing the container is greatly reduced.

In place of the aforementioned spring ring, it is possible to use a dimensionally stable plastic, which is easily bendable, but is so self-closed and stable, that it can be held in the correct position by a cam or groove. The dimensionally stable plastic can be held by a separate spring ring, but this can also be connected in one piece to the plastic.

I claim:

1. Closable container comprising a cup; an abrasive sponge inserted in said cup and immersed therein in a solution for the treatment of fingers, particularly for the removal of nail varnish, the sponge being absorptive and centrally provided with a hole for receiving at least one finger; a lid for closing said cup; and means for holding the abrasive sponge in said cup, said sponge being constructed in such a way and made from a material such that an outflow of liquid is still prevented if said cup with said lid removed accidentally comes to rest upside down, wherein said sponge has a density between 60 and 70 kg/m$^3$.

2. Container according to claim 1, wherein the sponge has a density of 65 kg/m$^3$.

3. Closable container comprising a substantially cylindrical cup having a neck portion;

an abrasive sponge inserted in said cup and immersed therein is a solution for cleaning and caring of fingers, particularly for removing nail varnish, said sponge being absorptive, having an upper surface and a central hole for receiving at least one finger;

a lid for closing said cup;

means for holding said sponge in said cup, said sponge being constructed and held in said cup in such a way and made from such a material that an overflow of solution is prevented if said cup with said lid removed accidentally comes to rest upside down, wherein the sponge material has a density between 40 and 90 kg/m$^3$;

a sealing disc-shaped cover entirely covering said surface of said sponge and said hole and sealingly abutting against said surface, said cover being held in said cup and having a tight central slit intended for perforation by a user's finger; and a cap-like outer seal provided at an open end of said neck portion and held therein, said seal having a second tight central slit intended for perforation by a user's finger, and having a vertical cylindrical wall engaging said cover at a peripheral edge thereof.

4. Container according to claim 3, wherein said cover engages against a shoulder formed at said neck portion.

5. Container according to claim 4, wherein said cover is engaged in an inner wall of said cup.

6. Container according to claim 5, wherein said cover is connected to the inner wall of said cup by welding.

7. Container according to claim 6, wherein said cover is connected to said inner wall by thermal welding.

8. Container according to claim 6, wherein said covering is connected to said inner wall by ultrasonic welding.

9. Container according to claim 3, wherein a space for thermal pressure compensation is provided between said cover and said seal.

10. Container according to claim 3, wherein a wall thickness of said cover decreases from a periphery thereof towards a center thereof.

11. Container according to claim 10, wherein said wall thickness decreases in a continuous manner.

12. Container according to claim 10, wherein said wall thickness decreases in a stepwise manner.

13. Container according to claim 3, wherein said cover is supported by an extension of a circumferential wall extended from a bottom of said cup.

14. Container according to claim 3, wherein said neck portion of said cup has an external thread for said lid.

15. Container according to claim 3, wherein an external diameter of said cup corresponds to that of the lid.

16. Container according to claim 3, wherein said slit in said cover slopes in such a way towards a surface of said cover that two edges of said slit overlap one another.

17. Container according to claim 3, wherein said slit in said cover is formed so that on one side of said cover it consists of a groove, in which engages a tongue formed on another side of said cover.

18. Container according to claim 3, wherein said slit in said cover is covered on an inside thereof by a sponge pad which prevents or delays the outflow of said liquid from said sponge.

19. Container according to claim 3, wherein said central hole is cylindrical.

20. Container according to claim 3, and further including a brush made from sponge for cleaning a wall of said central hole.

21. Container according to claim 3, wherein said hole in said sponge is formed by a star-shaped incision, into a center of which can be inserted the finger by forcing away individual wedge-shaped parts formed by a star of said incision.

22. Container according to claim 3, wherein said hole in said sponge is formed by a straight incision, into a center of which can be inserted the finger by forcing away the sponge parts bounded by the incision.

23. Container according to claim 3 wherein said cover has individual incisions and where individual incisions come together, the sponge has said hole for receiving the finger.

24. Container according to claim 3, wherein said sponge is made from a material selected from the group consisting of foam and foam rubber.

25. Container according to claim 3, wherein said sponge is selected from the group comprising open and closed pores.

26. Container according to claim 3, wherein said hole is formed by an incision of the shape selected from the group comprising straight, S, cross, crooked cross and star shape.

27. Container according to claim 3, wherein said hole in said sponge is formed by a hooked cross-shaped incision into a center of which the finger can be inserted.

* * * * *